United States Patent [19]

Takahashi

[11] 4,164,685

[45] Aug. 14, 1979

[54] MAGNETRON DEVICE

[75] Inventor: Hirokazu Takahashi, Tokyo, Japan

[73] Assignee: Tokyo Shibaura Electric Co., Ltd., Kawasaki, Japan

[21] Appl. No.: 832,952

[22] Filed: Sep. 13, 1977

[30] Foreign Application Priority Data

Sep. 14, 1976 [JP] Japan ..... 51-110076

[51] Int. Cl.[2] ..... H05B 39/00; H05B 41/14

[52] U.S. Cl. ..... 315/105; 315/39.51; 315/85; 315/94; 219/10.55 B; 219/10.55 D; 331/86

[58] Field of Search ..... 315/39.51, 85, 94, 101, 315/103, 105; 219/10.55 B, 10.55 D; 331/86, 87

[56] References Cited

U.S. PATENT DOCUMENTS

| | | | |
|---|---|---|---|
| 3,727,098 | 4/1973 | Crapuchettes | 315/39.51 |
| 3,789,263 | 1/1974 | Fritz et al. | 315/85 |
| 3,840,774 | 10/1974 | Iwata | 315/39.51 |
| 3,846,667 | 11/1974 | Hisada et al. | 315/39.51 |
| 3,873,883 | 3/1975 | Siever et al. | 315/105 |
| 3,916,247 | 10/1975 | Koinuma et al. | 315/39.51 |
| 3,922,612 | 11/1975 | Tashiro | 315/85 |

*Primary Examiner*—Saxfield Chatmon, Jr.
*Attorney, Agent, or Firm*—Cushman, Darby & Cushman

[57] ABSTRACT

A magnetron device emits through the filament terminals electromagnetic waves of a broad frequency band which act as noises to other electronic devices. The magnetron device comprises a filament or heater circuit for supplying heater voltage to the filament to emit thermal electrons from the cathode and an anode circuit for applying a required voltage across the filament and anode. The filament circuit is connected to one secondary winding of a power supply transformer and the anode circuit to the other secondary winding thereof. Connected to the anode power supply line is a filter device comprising a capacitor and a choking element having a sufficient inductance to reduce a relatively low frequency of the broad frequency band. This filter device is intended to reduce or suppress a large amount of the noise transmitted to the anode circuit out of a magnetron through filament terminals. Also connected to each of the two power supply lines of the filament circuit is a filter device comprising a capacitor and a choking element having an inductance. The filter device is intended to reduce or suppress the noise leaking from the anode circuit connecting the anode power supply line to the filament circuit. The three filter devices are received in a shield box connected to ground. The terminal portions of the three power supply lines project outside of the shield box.

12 Claims, 7 Drawing Figures

MAGNETRON DEVICE

BACKGROUND OF THE INVENTION

This invention relates to a magnetron device, and more particularly to improvements on means for suppressing electromagnetic waves emitted from the filament terminal of the magnetron device which act as noises to other electronic devices such as a television sets or radio sets.

It is generally known that a magnetron device emits noises having frequencies ranging approximately between 100 KHz and 1,000 MHz from the filament terminal, thus harmfully affecting other electronic devices such as a television sets or radio sets. With the prior art magnetron device, part of the filament circuit for applying voltage to a filament was generally shared by part of the anode circuit for applying voltage across the filament and anode in order to simplify the circuit arrangement. Accordingly, applying of voltages to the magnetron body containing the filament and anode could be effected through two filament terminals provided on the shield box and two power supply lines connected to said corresponding filament terminal. A magnetron device is generally provided with a filter device connected to each of two power supply lines and comprised of a choking element and capacitor to reduce or suppress such noises; and a shield box for receiving the filter devices and filament terminal. Various improvements have hitherto been made on the filter device of a magnetron. Some improvements are already set forth in U.S. Pat. No. 3,697,804. This known filter device can effectively reduce or suppress the noise induced from a magnetron through filament terminals, whose frequency has a relatively broad band ranging approximately between 20 MHz and 1,000 MHz. However, the prior art filter devices failed effectively to reduce or suppress noise having lower frequency bands than described above, for example, frequency bands of the order of several to 30 MHz. The reason is that since relatively large current such as 10 to 15 amperes flows through the filament of a magnetron device, difficulties have been presented in increasing the inductance of the choking element of a filter device connected to the filament from the standpoint of designing a magnetron device.

SUMMARY OF THE INVENTION

It is accordingly the object of this invention to provide a magnetron device which comprises means for effectively reducing or suppressing noises having a broad frequency band which are emitted from the filament terminals of the magnetron device.

According to an aspect of this invention, there is provided a magnetron device which comprises a magnetron body including a filament provided with two terminals and an anode; two filament power supply lines connected to the corresponding two filament terminals to supply the heater voltage; one anode power supply line connected to the filament to apply a required voltage across the anode and filament; a filter device including a choking element and connected to the power supply line of the anode to reduce or suppress noises; and a shield box for surrounding the filament terminal, the filter devices of the anode circuit and part of the power supply lines of said circuit to shield electromagnetic waves emitted from the power supply lines of the filament which act as noises having a relatively high frequency band.

DETAILED DESCRIPTION OF THE PREFERRED EMBODIMENT

There will now be described the preferred embodiment of this invention by reference to the accompanying drawings.

Figure 1:
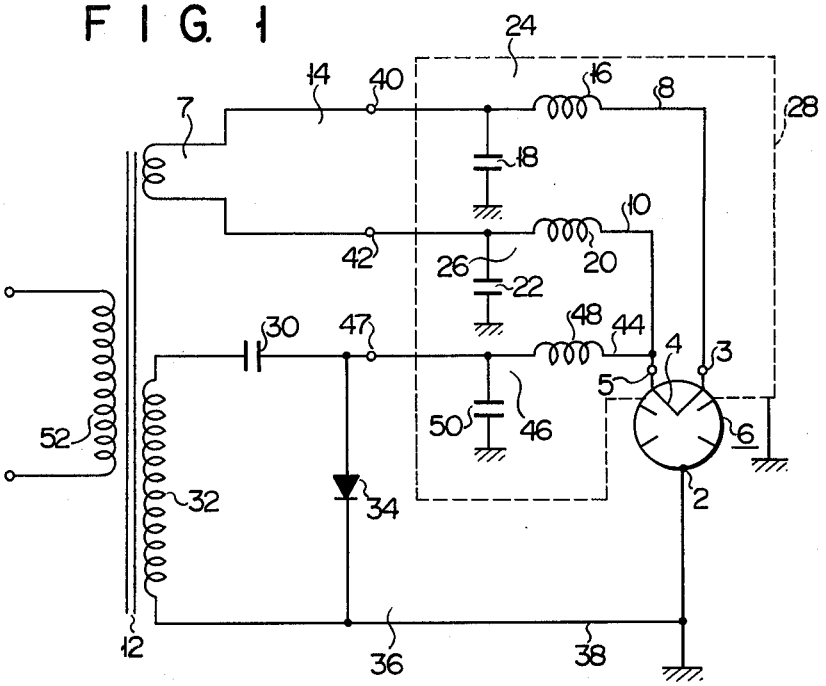
FIG. 1 is an equivalent circuit diagram of a magnetron device embodying this invention.

FIG. 1 showing the equivalent circuit of the magnetron device of this invention indicates a magnetron 6 comprising an anode 2 and filament 4. The filament 4 is of a direct-heat type and can function as a cathode and a heater. The terminals 3, 5 of the filament 4 are connected to a first secondary winding 7 of a power supply transformer 12 through power supply lines 8, 10 to form a filament circuit 14. A choking coil 16 is connected to one power supply line 8 of the filament circuit 14 and a capacitor 18 is connected between the choking coil 16 and ground. Similarly, a choking coil 20 is connected to another power supply line 10 of the filament circuit 14 and a capacitor 22 is connected between the choking coil 20 and ground. The choking coil 16 and capacitor 18 jointly form a first filter device 24 which reduces or suppresses noises given off from a magnetron during its operation and transmitted through the filament 4 and power supply line 8. Similarly, the choking coil 20 and capacitor 22 jointly form a second filter device 26. The filter devices 24, 26 and filament terminals 3, 5 are received in a shield box 28 connected to ground for shielding electromagnetic waves having a relatively high frequency which are given off from the power supply lines 8, 10.

The anode 2 and filament 4 are connected to a second secondary winding 32 of the power supply transformer 12 through the filament terminal 5 and a capacitor 30. A diode 34 is connected between the anode 2 connected to ground and filament 4 to form an anode circuit 36.

With the conventional magnetron device, the anode 2 and filament 4 are connected to the second secondary winding 32 of the power supply transformer 12 through the power supply line 10 of the filament or heater circuit 14 and a power supply line 38 connected to the anode 2. Namely, the prior art magnetron device only had first and second terminals 40, 42 projecting outward from the shield box 28, with the terminal 42 connected to the second secondary winding 32 of the power supply transformer 12.

With the magnetron device of this invention, however, the anode 2 and filament 4 are connected, as shown in FIG. 1, to the second secondary winding 32 of the power supply transformer 12 through the power supply lines 38, 44. A third terminal 47 is newly provided with the shield box 28. This new terminal 47 is connected to the second secondary winding 32 of the power supply transformer 12 through the capacitor 30. A third filter device 46 is connected to the power supply line 44 of the cathode circuit 36 received in the shield box 28 to reduce or suppress noises transmitted through the filament 4. A choking coil 48 is connected to the power supply line 44, and a capacitor 50 is connected between the choking coil and ground.

The magnetron device of this invention constructed as described above effectively reduces or suppresses noise of a broad frequency band which is emitted through the filament terminal 5 of the magnetron device. Among the electromagnetic waves having the prescribed frequency of, for example, 2,450 MHz which are generated in the magnetron body, noise-forming electromagnetic waves generally have a frequency ranging, for example, between 100 KHz and 100 MHz. Most of the noise is emitted outside of the magnetron body in the state of being superposed on the anode current through the filament terminal 5. The reason is that a high electric field is applied to an interaction space within the magnetron body, and noise arises in the magnetron body by the motion of electrons and/or ions resulting from the action of said high electric field. With the prior art magnetron device, part of the filament circuit was shared, as previously described, by part of the anode circuit through which the anode current passed. Moreover, the power supply lines of the filament circuit through which current as large as 10 to 15 amperes was conducted were required to have a large diameter, failing to have a sufficiently large inductance effectively to reduce or suppress noise having a broad frequency band, particularly noise of a lower frequency than 30 MHz.

As mentioned above, the noise is superposed on the anode current and then is emitted outside the magnetron body. In view of this, the anode circuit through which relatively small current flows, is set independently of the filament circuit through which large current is introduced, though it shares the filament with the filament circuit. Further, the anode circuit is provided with a choking coil having a sufficient inductance to reduce or suppress noises, particularly, those having a lower frequency than 30 MHz. Therefore, most of the noise of a broad frequency band which has been emitted from the filament terminal 5 in the state of being superposed on the anode current is reduced or suppressed by the filter device 46 and blocked by the shield box 28, thus failing to propagate outside the magnetron device.

The capacitor 50 of the filter device 46 need not be connected to the power supply line 44. But it may be replaced by a stray capacitance occurring between the power supply line 44 and the shield box 28.

According to this invention, the first filter device 24 and second filter device 26 connected to the power supply lines 8 and 10, respectively need not be provided to the magnetron device. This is because the filter devices 24 and 26 are to reduce or suppress small noise which leaks from the anode circuit into the filament circuit through the filament terminal 5.

Figure 2:
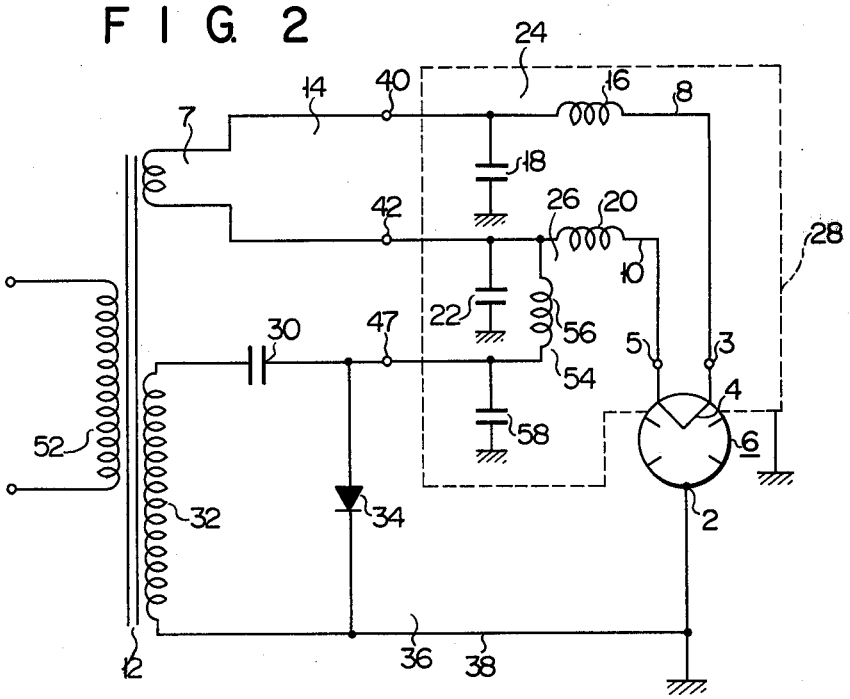
FIG. 2 is an equivalent circuit diagram of a modification of the embodiment of FIG. 1.

There will now be described a modification of the magnetron of FIG. 1 embodying this invention by reference to FIG. 2 showing the equivalent circuit of said modification. With the magnetron device of FIG. 1, the filter device 46 is connected to the filament terminal 5. In constrast, with the modification of FIG. 2, a filter device 54 comprising a choking coil 56 and capacitor 58 and received in the shield box 28 is connected to the filament terminal 5 through a choking element 20. The modification of FIG. 2 offers the advantage of allowing the choking coil 56 of the filter device 54 to have a smaller inductance than that of the choking element 48 of the filter device 46 of FIG. 1. The reason is that the choking element of the filter device of FIG. 2 is formed of the choking coil 56 and choking coil 20.

There will now be described by reference to FIGS. 3 to 7 various concrete arrangements corresponding to the magnetron device of FIGS. 1 and 2 embodying this invention. The same parts of FIGS. 3 to 7 as those of FIGS. 1 and 2 are denoted by the same numerals.

Figure 3:
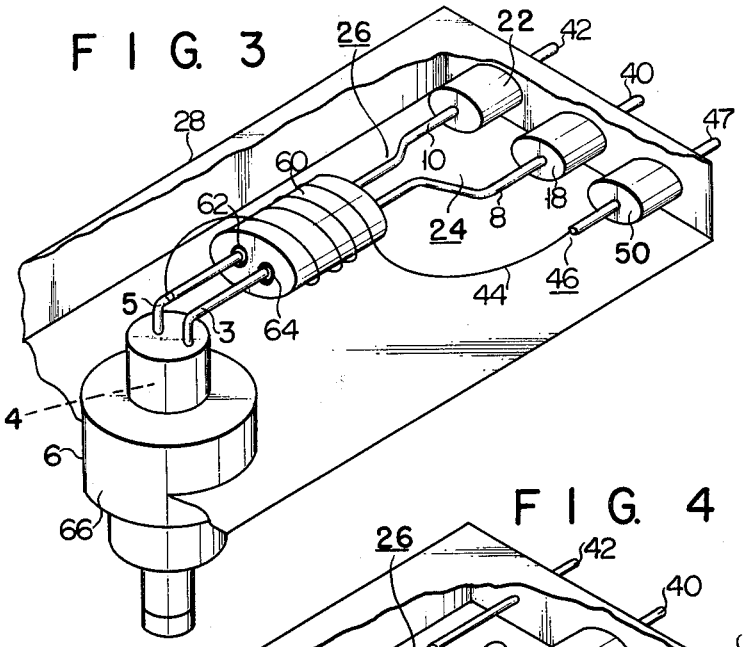
FIGS. 3 to 5 are oblique views of various arrangements corresponding to the equivalent circuit of the embodiment of FIG. 1.

As seen from FIG. 3, the power supply lines 8, 10 of the filament circuit 14 which extend from the cathode 4 of the magnetron 6 are formed of a conductor having a relatively large diameter due to large current flowing through the filament circuit 14. In constrast, the power supply line of the anode circuit 36 is formed of a conductor having a relatively small diameter, because large current does not flow through the anode circuit 36. The power supply lines 8, 10 penetrate a rod-like magnetic member, for example, a ferrite bead 60, pass through the corresponding feed-through type capacitors 18, 22 fitted to the shield box 28 and project outside of the shield box 28. The ferrite bead 60 and the power supply line 8 conducted through a hole 64 penetrating the ferrite bead 60 jointly constitute the choking element 16. Similarly, the ferrite bead 60 and the power supply line 10 extending through a hole 62 penetrating the ferrite bead 60 collectively form the choking element 20. The power supply lines 8, 10 having a relatively large diameter are little likely to be deformed into a coil-like shape, and the choking elements 16, 20 do not have an appreciably large inductance. Therefore, the choking elements 16, 20 can only reduce noises of a relatively high frequency and small amount of noises, but with a sufficient effect. Part of the power supply line 44 of the anode circuit 36 is wound about the rod-like ferrite bead 60, penetrates the feed-through type capacitor 50 and project outside of the shield box 28. This anode power supply line 44 having a relatively small diameter can be easily made into a coil shape and consequently act as the choking element 48 having a relatively large inductance in cooperation with the ferrite bead 60. Therefore, the choking element 48 can suppress relatively large amount of noises having a broad frequency band. The shield box 28 is electrically connected to ground.

Figure 4:
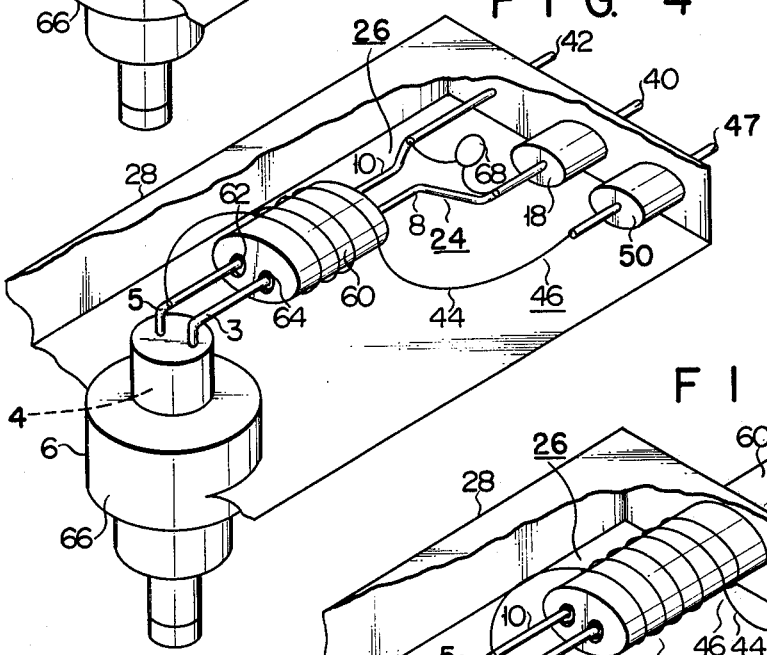

The magnetron device of FIG. 4 is modified from that of FIG. 3. As seen from FIG. 4, the feed-through type capacitor 22 connected to one power supply line 10 of the filament circuit 14 is replaced by the ordinary capacitor 68.

Figure 5:
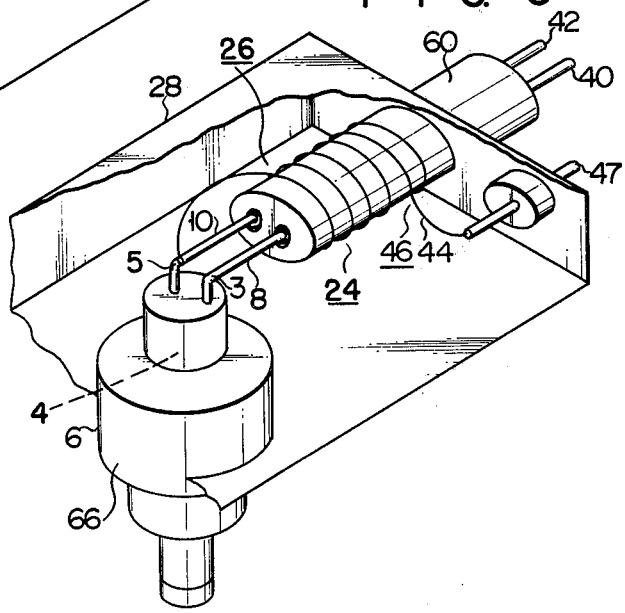

With the magnetron device of FIG. 5 modified from that of FIG. 3, two feed-through type capacitors 18, 22 are omitted. The rod-like ferrite bead 60 penetrated by the cathode power supply lines 8, 10 is made to pass through the shield box 28. With the modification of FIG. 5, that section of the rod-like ferrite bead 60 which constitutes a region lying between the power supply line 8 and the junction of the ferrite bead 60 and shield box 28 acts as a capacitor 18. Similarly, that section of the rod-like ferrite bead 60 which forms a region lying between the power supply line 10 and the junction of the ferrite bead 60 and shield box 28 acts as a capacitor 22.

Figure 6:
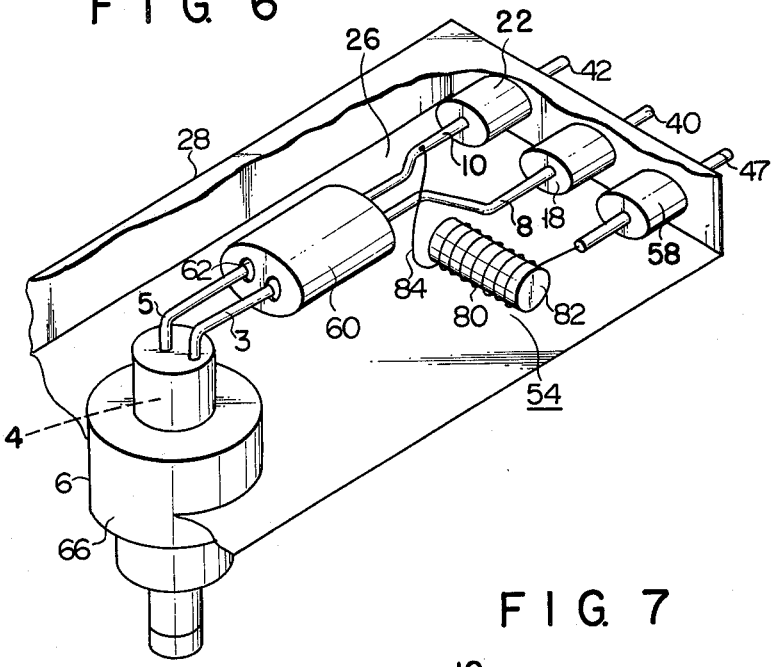
FIGS. 6 and 7 are oblique views of various arrangements corresponding to the equivalent circuit of the embodiment of FIG. 2.

As shown in FIG. 6, the choking coil 80 is connected between the capacitor 58 and the junction between the capacitor 22 and the choking coil 20 comprising the rod-like ferrite bead 60 and part of the power supply line 10. The choking coil 80 is formed of a rod-like ferrite member 82 and a part of the power supply line 84 of the anode circuit 36. The part of the power supply line 84 is wound about the rod-like ferrite member 82. With the modification of FIG. 6 it is easy to determine the inductance of the choking coil 80. The magnetron device of FIG. 7 is modified from that of FIG. 6.

Figure 7:
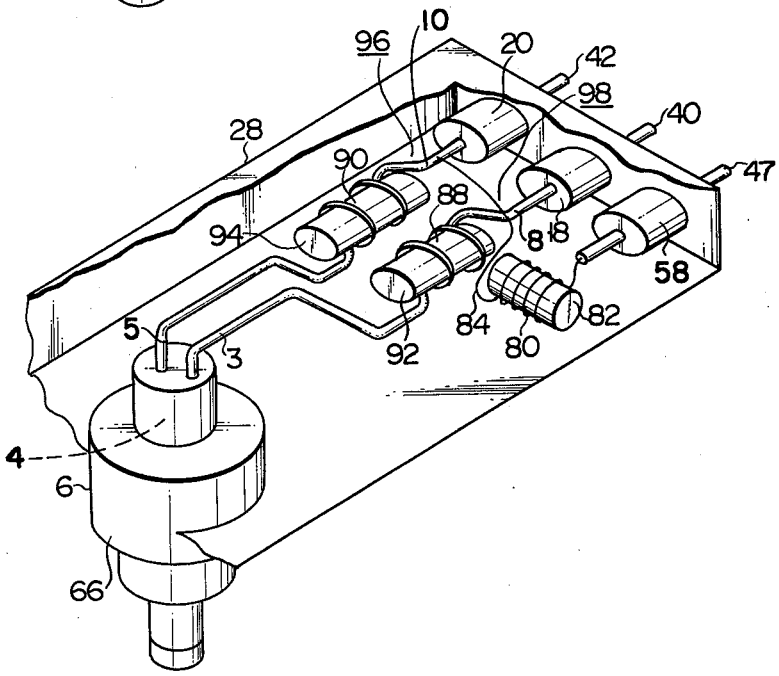

As seen from FIG. 7, a choking coil 88 is formed of a ferrite member 92 and part of the power supply line 8 wound about the ferrite member 92. Similarly, another choking coil 90 is formed by a ferrite member 94 and part of the power supply line 10 wound about the ferrite member 94. The inductance of the choking coils 88 and 90 is more larger than that of the choking elements 16 and 20 of the embodiment shown in FIG. 6. So the filter devices 96 and 98 can reduce or suppress the noise of a relatively low frequency range in the filament circuit 14.

The modifications of FIGS. 4 to 7 can fully serve as the magnetron device of FIG. 1 or 2.

To give further description, the lower limit frequency of noises reduced or suppressed by the filter device 46 of the anode circuit 36 may be calculated from a formula given below:

$$f=1/(2\pi\sqrt{LC})$$

where L denotes the inductance of the choking coil 48 and C the capacitance of the capacitor 50. As apparent from the above formula, the filter device 46 comprising the choking coil 48 can reduce or suppress noises having a considerably low frequency band.

As mentioned above, this invention provides a magnetron device comprising a filter element capable of effectively reducing or suppressing noises having a broad frequency band which are given off from the filament terminals of the magnetron device.

What is claimed is:

1. A magnetron device comprising:

a magnetron body including an anode and a filament provided with first and second filament terminals;

first, second and third power supply terminals adapted to be connected to a power source;

first and second filament power supply lines for supplying current to the filament, the first power supply line being connected between the first filament terminal and the first power supply terminal and the second power supply line being connected between the second filament terminal and the second power supply terminal;

one anode power supply line connected between the third power supply terminal and one of the filament terminals for applying a predetermined voltage across the anode and the filament;

a filter device including a choking element and connected to the anode power supply line for reducing noises transmitted from the filament terminals; and a shield box for receiving the filament terminals, the filter device and the power supply lines to shield electromagnetic waves which are emitted from the filament terminals and from the power supply lines, said power supply terminals being attached to said box.

2. The magnetron device according claim 1, wherein the filter device connected to the anode power supply line includes a capacitance element connected to ground.

3. The magnetron device according to claim 2, wherein the capacitance element connected to the anode power supply line is a feed-through type capacitor which is formed of dielectric member connected to the shield box and penetrated by the anode power supply line.

4. The magnetron device according to claim 1, wherein the magnetron device further comprises first and second filter devices received in the shield box and connected to said first and second filament power supply lines, respectively, and each including a choking element.

5. The magnetron device according to claim 4, wherein each of the first and second filter devices connected to the filament power supply lines comprises a capacitance element connected between each choke element and ground.

6. The magnetron device according to claim 5, wherein the capacitance element is a feed-through type capacitor which is formed of dielectric member connected to the shield box and penetrated by the filament power supply line.

7. The magnetron device according to claim 4, wherein the choking element of each of the first and second filter devices is formed of a magnetic member and that part of the filament power supply line which extends through the magnetic member.

8. The magnetron device according to claim 7, wherein the magnetic member is fixed to the shield box.

9. The magnetron device according to claim 1, wherein the magnetron device further comprises a first and a second filter devices which are connected to the two filament power supply lines, respectively, to reduce noises and received in the shield box; each of the first and second filter devices includes a choking element formed of a rod-like magnetic member and that part of the filament power supply line which passes through the magnetic member; and the choking element of the filter device connected to the anode power supply line is constituted by that part of the anode power supply line which is wound about the rod-like magnetic member.

10. The magnetron device according to claim 1, wherein the magnetron device further comprises a first and second filter devices which are connected to each of the two filament power supply line to reduce noises and received in the shield box; each of the first and second filter devices includes a choking element and the filter device connected to the anode power supply line is connected to the filament through one of the first and second filter devices.

11. The magnetron device according to claim 1, wherein the choking element of the filter device connected to the anode power supply line is constituted by a magnetic member and that part of the anode power supply line which is wound about the magnetic member.

12. The magnetron device according to claim 11, wherein the magnetron device further comprises first and second filter devices which are connected to two filament power supply lines, respectively, and received in the shield box and each of which includes a choking element formed of a magnetic member and that part of the filament power supply line which is wound about the magnetic member.

* * * * *